US005533375A

United States Patent [19]

Chen et al.

[11] Patent Number: 5,533,375

[45] Date of Patent: Jul. 9, 1996

[54] METHOD FOR MAKING SEAMLESS TUBES FROM HOLLOW BILLETS

[75] Inventors: Chin-Fu Chen, Da-Li; Wen-Hwa Lu, Shoei; Shan-Chang Chueh, Taipei, all of Taiwan

[73] Assignee: Industrial Technology Research Institute, Hsinchu Hsien, Taiwan

[21] Appl. No.: 275,175

[22] Filed: Jul. 14, 1994

[51] Int. Cl.[6] ..... B21C 23/00

[52] U.S. Cl. ..... 72/254; 72/253.1; 72/268

[58] Field of Search ..... 72/253.1, 254, 72/266, 268, 273

[56] References Cited

U.S. PATENT DOCUMENTS

| | | | |
|---|---|---|---|
| 3,404,552 | 10/1968 | Murphy et al. | 72/266 |
| 4,056,964 | 11/1977 | Shibasaki et al. | 72/273 |
| 4,316,373 | 2/1982 | Zilges et al. | 72/273 |
| 4,967,583 | 11/1990 | Watanabe et al. | 72/264 |
| 5,007,274 | 4/1991 | Stewart | 72/273 |
| 5,016,456 | 5/1991 | Hansjörg Furrer et al. | 72/38 |
| 5,354,192 | 10/1994 | Soejina et al. | 72/273 |

FOREIGN PATENT DOCUMENTS

| | | | |
|---|---|---|---|
| 0040615 | 4/1985 | Japan | 72/254 |

*Primary Examiner*—Daniel C. Crane
*Assistant Examiner*—Ed Tolan
*Attorney, Agent, or Firm*—W. Wayne Liauh

[57] ABSTRACT

An apparatus and method for manufacturing seamless tubes from hollow billets that will not contain metal oxide, which may be introduced into the extruded metal tube from an oxide layer formed on the inner surface of the hollow billets, so as to improve the quality of the extruded product and extend the service life of the extrusion piercer rod. A de-oxide latch, which has a substantially circular disk shape and is dimensioned such that it is slightly larger than the inner diameter of the hollow billet, is placed in front of the piercer rod so as to remove the metal oxide layer formed on the inner surface of the hollow billet through an upsetting shearing force ahead of the normal stress generated by the forward movement of the extrusion stem. The extrusion apparatus also utilizes a screw and pierce doughnut combination to securely affix the piercer rod to the stem and to effectuate the extrusion of the hollow billet through an extrusion die to form seamless tubes. This arrangement allows an easy interchange between a piercer rod, which is used for extruding hollow billets, and a ram, which is used for extruding a solid billet, so as to improve the versatility of the extrusion apparatus and reduce the manufacturing cost.

9 Claims, 3 Drawing Sheets

METHOD FOR MAKING SEAMLESS TUBES FROM HOLLOW BILLETS

FIELD OF THE INVENTION

This invention relates to an apparatus and method for the manufacturing of seamless tubes from hollow billets via an extrusion process. More specifically, the present invention relates to an extrusion apparatus and method for the manufacturing of seamless aluminum tubes from hollow billets which eliminate the inclusion of aluminum oxide scraps into the aluminum tubes and therefore enhance the service life of the extrusion dies, reduce the frequency of extrusion die changes, improve the quality of the extruded product, and reduce manufacturing cost.

BACKGROUND OF THE INVENTION

Seamless aluminum tubes, which include aluminum or aluminum alloy tubes have been widely used in the industry, and are considered an important element in the optical, aerospace, and mechanical industries. Conventionally, seamless aluminum tubes are made involving a piercing process through solid billets to form the pierced hollow central portions. The conventionally piercer-type extrusion process for making seamless aluminum tubes often suffers from heavy consumption of piercer rods due to breakage and/or constant rubbing and abrading between the piercer rod and the billet, thus resulting increased equipment cost relative to the conventional direct extrusion molding process. To minimize the consumption of piercer rods, improved processes have been developed which utilize hollow billets to making seamless tubes. More recently, new techniques have also been developed using a centrifugal or a semi-continuous casting process to make hollow billets.

However, it was discovered by the inventors that, although the use of hollow billets presents several distinct advantages over the conventional process, it also introduces new problems. More specifically, if the hollow billets are not immediately processed after they are formed, an oxide layer will form on the inner surface of the hollow billet. Such an oxide layer, due to its stiffness, often introduces defects in the seamless tubes and causes damages to the piercer rod. Furthermore, the present seamless tubing extrusion apparatus designed for extruding hollow billets does not allow easy switch to the mode of extruding solid billets. The latter disadvantage limits the application of an extrusion apparatus and increases the manufacturing cost.

SUMMARY OF THE INVENTION

Having discussed the problems associated with the prior art extrusion apparatuses and methods in making seamless tubes from hollow billets, the primary object of the present invention is to develop an improved apparatus and method that will ameliorate the problems observed in the prior art. More specifically, the primary object of the present invention is to provide an improved apparatus and method for the manufacturing of seamless tubes, more particularly seamless aluminum alloy tubes, from hollow billets that will not contain metal oxide, which may be introduced into the extruded metal tube from an oxide layer formed on the inner surface of the hollow billets. The apparatus and method disclosed in the present invention allow improved seamless tubes to be formed, as a result of its ability to exclude metal oxide from being introduced into the final extruded product, it also prolongs the life of the extrusion dies, and reduces the manufacturing cost. Furthermore, the present invention allows an easy switch from processing hollow billets to solid billets, thus improving the flexibility of the extrusion apparatus and further reducing the capital as well as operational costs for manufacturing seamless tubes.

In the extrusion apparatus disclosed in the present invention, a de-oxide latch is placed in front of the piercer rod. The de-oxide latch has a substantially circular disk shape and is dimensioned such that it is diametrically slightly larger than the inner diameter of the hollow billet, so as to remove the metal oxide layer, which may be formed on the inner surface of the hollow billet through an upsetting shearing force ahead of the normal stress generated by the forward moving extrusion stem. The apparatus is also designed that, after the de-oxide latch has completed its round of removing the oxide layer through the shearing force, a normal stress will be applied on the hollow billet to start the extrusion operation.

Furthermore, the extrusion apparatus disclosed in the present invention utilizes a screw and piercer doughnut combination to securely affix the piercer rod to the stem; the piercer doughnut is also subsequently used in the extrusion of the hollow billet through the extrusion die. This allows an easy interchange between a piercer rod, which is used for extruding hollow billets, and a ram, which is used for extruding a solid billet. This feature allows the apparatus of the present invention to be able to work with hollow billets as well as solid billets as the starting materials; it increases the flexibility of the extrusion apparatus and reduces capital as well as operational costs.

BRIEF DESCRIPTION OF THE DRAWING

The present invention will be described in detail with reference to the drawings showing the preferred embodiment of the present invention, wherein.

DETAILED DESCRIPTION OF THE PREFERRED EMBODIMENT

The present invention will now be described more specifically with reference to the following example. It is to be noted that the following descriptions of example including preferred embodiment of this invention are presented herein for purpose of illustration and description; it is not intended to be exhaustive or to limit the invention to the precise form disclosed.

Figure 1:
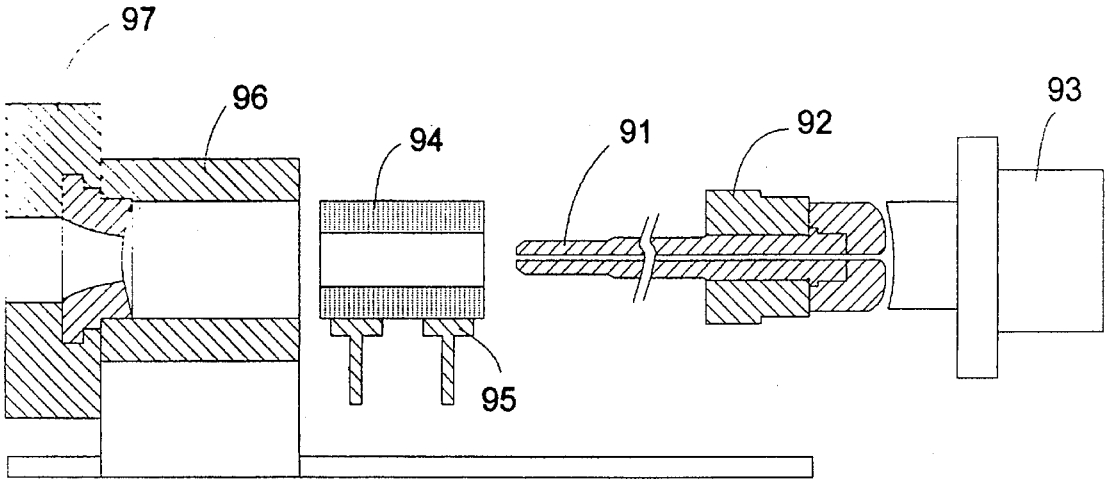
(Prior Art) Fig. 1
FIG. 1 is a schematic drawing of a prior art extrusion apparatus for making seamless tubes from hollow billets.
Figure 2:
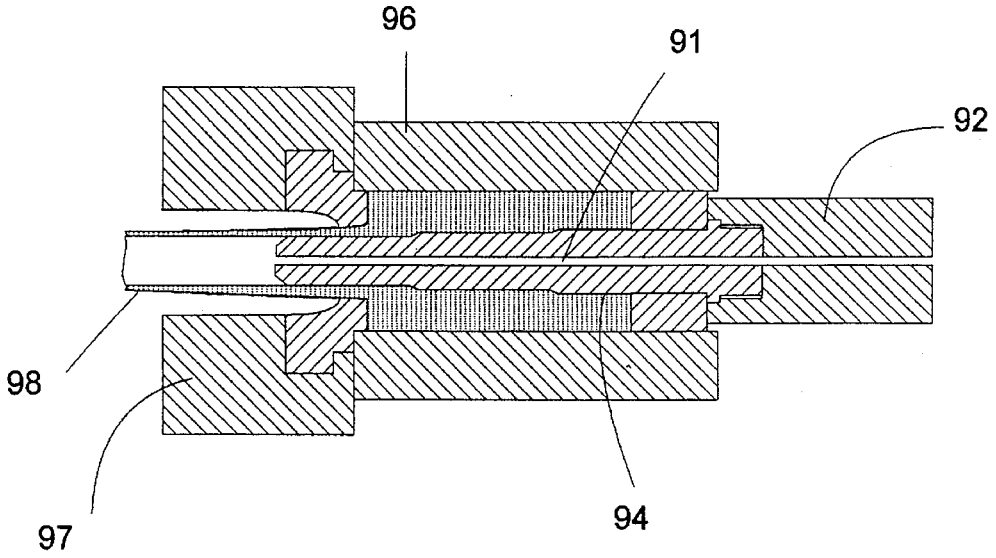
(Prior Art) Fig. 2
FIGS. 2 is a schematic diagram showing the operations of the prior art extrusion apparatus as shown in FIG. 1.

Now referring to the drawings. FIG. 1 is a schematic drawing of a prior art extrusion apparatus for making seamless tubes from hollow billets. And FIG. 2 is a schematic diagram showing the operations of the prior art extrusion apparatus as shown in FIG. 1. The prior art extrusion apparatus comprises a billet container 96, a die 97, a piercer rod 91 contained in a ram sleeve 92 and affixed to a ram press 93. During the extrusion operation, a hollow billet 94 made of extrudable metal is placed on top of a billet elevator 95. The ram press 93 forces the piercer rod 91 into the internal space of the hollow billet 94 and pushes the hollow billet 94 into the billet container 96. The ram press 93 further pushes the hollow billet 94 through the die 97. As a result of the geometric restriction of die 97, the continual press by the ram press 93, and the presence of the piercer rod 91, a seamless tube 98 is formed.

Hollow metal billets are typically formed under high-temperature conditions. As a result, a metal oxide layer can be formed on the inner surface thereof. Although the extent may vary, the existence of this oxide layer, which has high hardness and abrasiveness and is in direct contact with the piercer rod during the extrusion process, can cause damages to the piercer rod and shorten the useful life thereof. Furthermore, after the extruded tube is released from the die, due to sudden changes in the stresses applied thereon, the oxide layer, most of which will be in a scrap form due to their frictional contact with the piercer rod, will be transported into the internal portions of the extruded product. The presence of the undesirable metal oxide will adversely affect the mechanical strength of the extruded product, reduce it resiliency, or even render its quality unacceptable. The increased consumption of the piercer rod due to its intimate frictional contact with the hard metal oxide layer also causes an increase in the manufacturing cost.

Furthermore, in the extrusion apparatus disclosed in the prior art, the piercer rod is fixed to the ram press via a piercer sleeve. This makes it very cumbersome to change the piercer rod into a ram head, if a solid billet instead of a hollow billet is used in the extrusion operations.

Figure 3:
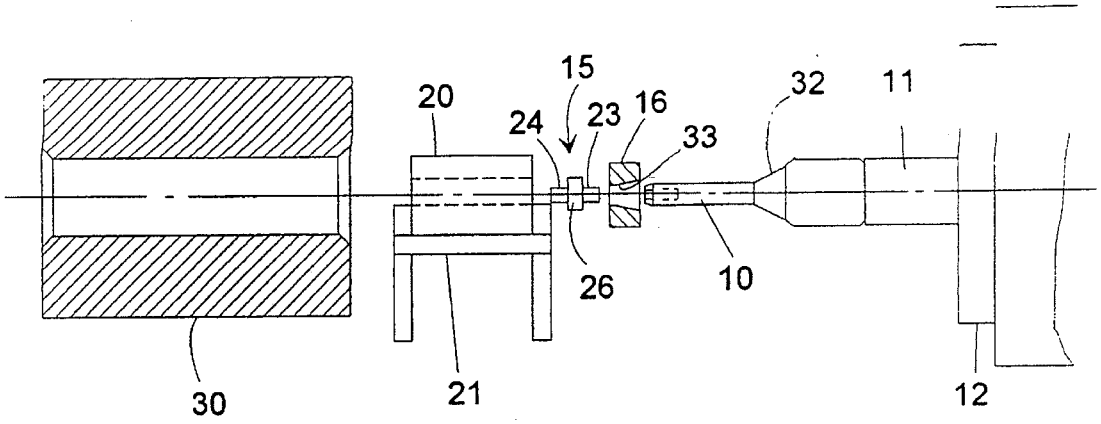
FIG. 3 is a schematic drawing showing a preferred embodiment of the extrusion apparatus of the present invention.
Figure 4:
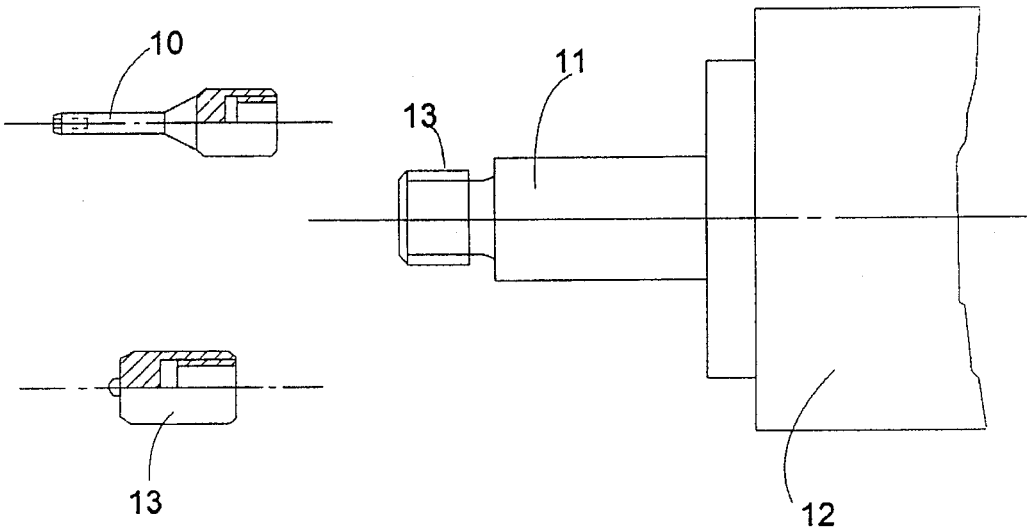
FIG. 4 is a schematic drawing showing the interchangeability between a piercer rod mode for extruding a hollow billet, and a ram for extruding a solid billet.

FIG. 3 is a schematic drawing showing a preferred embodiment of the extrusion apparatus of the present invention. The extrusion apparatus of the present invention comprises a piercer rod 10 connected to a stem 11, which is connected to a ram press 12, a billet container 30, a piercer doughnut 16 to be sleeved upon the piercer rod 10, a billet elevator 21, on which a hollow billet 20 is placed, and a de-oxide latch placed in front of the piercer rod 10. FIG. 4 is a schematic drawing showing the interchangeability of the extrusion apparatus of the present invention, by which a piercer rod 10 can be easily replaced with a ram head 13 for extruding a solid billet. Either of the piercer rod 10 or the ram head 13 is provided with a threadable connection for connecting with the stem 11. The piercer doughnut 16 strengthens the threadable connection and enhances the stability thereof when the piercer rod 10 is used. The piercer rod 10 has a thickened but tapered rear portion 32 for receiving the piercer doughnut 16, which is a ting-shaped member having a tapered inner surface 33 matching tapered rear portion 32 of the piercer rod. The piercer doughnut 16 also forces the hollow billet to be extruded through the die 40. The de-oxide latch 15 contains a substantially circular latch disk 26, which is affixed to a front latch stem 24 and a rear latch stem 23 on the front and rear surfaces, respectively, thereof. The latch disk 26 is slightly larger in diameter than the diameter of the hollow portion of the hollow billet 20. The rear latch stem 23 is adapted to be received by the piercer doughnut 16. And the front latch stem 24 is smaller in diameter than the hollow portion of the hollow billet 20 so as to allow the former to be inserted into the latter and travel therethrough.

Figure 5:
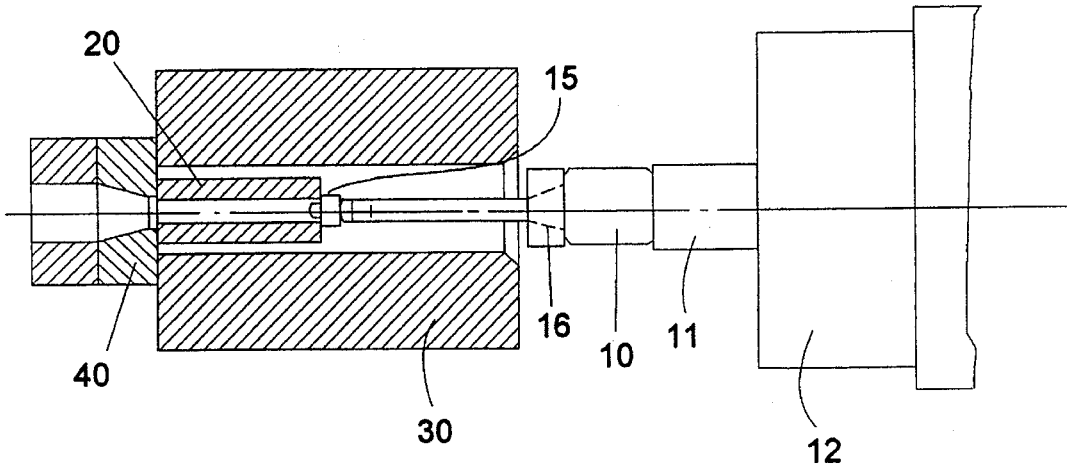
FIG. 5 is a schematic diagram showing an operation of the extrusion apparatus of the present invention according to FIG. 3 during the extrusion step.
Figure 6:
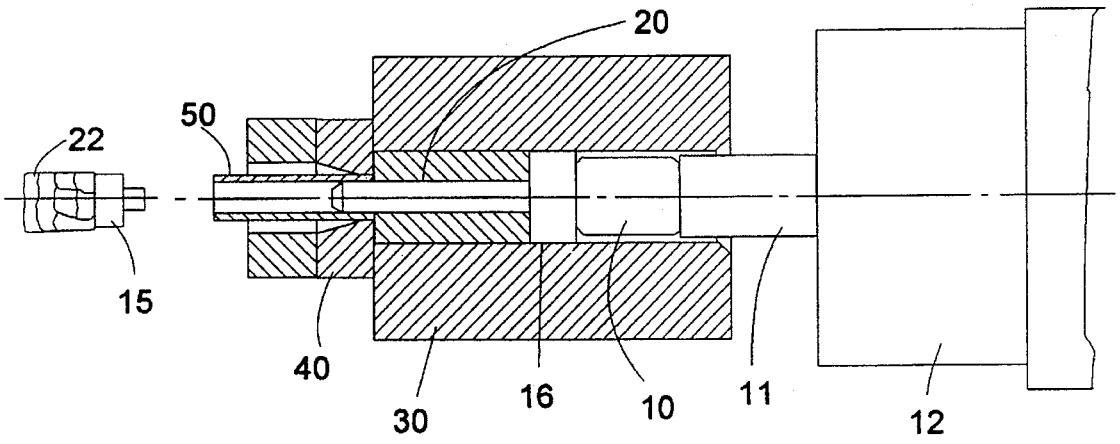
FIG. 6 is a schematic diagram showing an operation of the extrusion apparatus of the present invention according to FIG. 3 after the completion of the extrusion step.

FIG. 5 is a schematic diagram showing an operation of the extrusion apparatus of the present invention according to FIG. 3 during the extrusion step. As a result of the forward movement of the ram press 12, the stem 11 and the piercer rod 10 will move forward, causing the piercer rod to be engaged with the piercer doughnut 16. Because the latch disk 26 is diametrically larger than the hollow portion of the hollow billet 20, the hollow billet 20 will be pushed forward until it is stopped by the die 40. At this time, the de-oxide latch 15 will be sheared into and through the hollow portion of the hollow billet 20. The shearing force generated by the forward movement of the de-oxide latch 15 causes a oxide layer 22 on the inner surface of the hollow billet 20 to be sheared off and collected on the front latch stem 24. FIG. 6 is a schematic diagram showing an operation of the extrusion apparatus of the present invention according to FIG. 3 after the completion of the extrusion step. The piercer rod 10 is so dimensioned such that the de-oxide latch 15, with the sheared oxide layer 22 attached thereto, will be separated from the die 40 before the piercer doughnut 16 engages with the front end of the hollow billet 20 to begin the extrusion process. As shown in FIG. 6, a seamless tube 50 will be formed as a result of the cooperative action between the piercer rod 10 and the orifice shaped die 40. This portion of the extrusion process is well-known in the art and will not be repeated in the present invention.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A method for manufacturing seamless tubes from a hollow billet, said hollow billet having an inner surface, and said method comprising the steps of:

(a) obtaining an extrusion apparatus comprising:

(I) a die, a billet container, and means for connecting said die to said billet container;

(ii) an extrusion means which comprises a ram press, a piercer rod, and a ram stem, wherein said ram stem is connected to both said ram press and said piercer rod therebetween to effectuate simultaneous movement thereof, said extrusion means further comprises a moving means for moving said ram press;

(iii) a ring-shaped piercer doughnut sleeved upon said piercer rod, said piercer doughnut has a greater overall dimension than said inner surface of said hollow billet;

(iv) positioning means for placing said hollow billet between said extrusion means and said billet container; and (v) a de-oxide latch, which is a substantially circular latch disk with a rear side and a front side placed in front of said piercer rod and engageable therewith at said rear side of said latch disk, said latch disk is diametrically larger than said inner surface of said hollow billet so as to cause an outer layer of said inner surface of said hollow billet to be sheared off when said de-oxide latch is pushed through said inner surface of said hollow billet by said piercer rod;

(b) aligning said hollow billet between said extrusion means and said billet container;

(c) moving said ram press to push said hollow billet into said billet container and against said die;

(d) continuing moving said ram press so as to force said de-oxide latch to shear off said outer layer of said inner surface of said hollow billet; and (e) further continuing moving said ram press so as to extrude said hollow billet through said die to form a seamless tube.

2. A method for manufacturing seamless tubes according to claim 1 wherein said hollow billet is made of aluminum or aluminum alloys.

3. A method for manufacturing seamless tubes according to claim 1 wherein said de-oxide latch has a rear latch stem on said rear side thereof for engaging with said piercer rod.

4. A method for manufacturing seamless tubes according to claim 3 wherein said de-oxide latch further has a front latch stem on said front side of said latch disk for collecting said outer layer of said inner surface of said hollow billet that has been sheared off by said latch disk.

5. A method for manufacturing seamless tubes according to claim 4 wherein said outer layer of said inner surface of said hollow billet contains metal oxide.

6. A method for manufacturing seamless tubes according to claim 1 wherein said piercer rod is connected to said ram stem via a threadable connecting means.

7. A method for manufacturing seamless tubes according to claim 6 wherein said threadable connecting means comprises a cap portion on said piercer rod with a female threaded portion, and a male threaded portion on said ram stem.

8. A method for manufacturing seamless tubes according to claim 7 wherein said piercer rod contains a tapered portion near said cap portion, and said piercer doughnut is a ring-shaped member that has an internally tapered portion matching said tapered portion of said piercer rod for engagement therebetween.

9. A method for manufacturing seamless tubes according to claim 8 wherein said piercer rod and said billet container are so dimensioned such that said de-oxide latch will fall off from said die before said piercer doughnut begins extruding said hollow billet through said die.

* * * * *